US007987997B2

(12) United States Patent
Glogovsky, Jr.

(10) Patent No.: US 7,987,997 B2
(45) Date of Patent: Aug. 2, 2011

(54) BED FRAME DISPLAY UNIT

(75) Inventor: Ronald J. Glogovsky, Jr., Sycamore, IL (US)

(73) Assignee: West London Graphics, Inc., Dekalb, IL (US)

( * ) Notice: Subject to any disclaimer, the term of this patent is extended or adjusted under 35 U.S.C. 154(b) by 702 days.

(21) Appl. No.: 12/042,622

(22) Filed: Mar. 5, 2008

(65) Prior Publication Data

US 2009/0223910 A1 Sep. 10, 2009

(51) Int. Cl.
*A47F 29/00* (2006.01)

(52) U.S. Cl. ..... 211/28

(58) Field of Classification Search ..... 211/28, 211/13.1, 162; 5/133, 134, 496, 497, 499
See application file for complete search history.

(56) References Cited

U.S. PATENT DOCUMENTS

| | | | | | |
|---|---|---|---|---|---|
| 1,020,331 | A * | 3/1912 | Taylor | 211/28 |
| 1,071,671 | A * | 8/1913 | McCurdy | 211/28 |
| 1,257,611 | A * | 2/1918 | Kelly | 211/28 |
| 2,076,848 | A * | 4/1937 | Keiver | 211/28 |
| 2,348,398 | A * | 5/1944 | Lorey et al. | 211/28 |
| 2,565,027 | A * | 8/1951 | Jensen | 5/134 |
| 3,185,306 | A * | 5/1965 | Delaney | 211/28 |
| 3,357,569 | A * | 12/1967 | Goodman et al. | 211/28 |
| D257,623 | S * | 12/1980 | Bue et al. | D6/393 |
| 4,678,085 | A * | 7/1987 | Sando | 211/28 |
| 5,484,195 | A * | 1/1996 | O'Donnell | 312/125 |
| 5,499,407 | A * | 3/1996 | Atwell et al. | 5/1 |
| 6,503,188 | B1 * | 1/2003 | August | 600/27 |
| 2008/0086814 | A1 * | 4/2008 | Wootten | 5/499 |
| 2009/0223910 | A1 * | 9/2009 | Glogovsky, Jr. | 211/28 |

* cited by examiner

*Primary Examiner* — Sarah Purol
(74) *Attorney, Agent, or Firm* — Reinhart Boerner Van Deuren P.C.

(57) ABSTRACT

A mattress display is provided. The mattress display includes a base frame built of angle bars for supporting a mattress. A handle mounted to the base frame facilitates manipulation via wheels mounted to the frame. Signage can be mounted to the handle.

14 Claims, 4 Drawing Sheets

BED FRAME DISPLAY UNIT

FIELD OF THE INVENTION

The present invention generally relates to retail displays and more particularly relates to retain mattress displays for marketing mattresses in retail stores.

BACKGROUND OF THE INVENTION

Mattresses are displayed for retail sale in a number of different environments. While not limited thereto, one commercial setting where mattresses are sold is in warehouse stores wherein pallet racks are typically used to both store and display merchandise. Often times, products may be arranged or tucked under pallet racks on the floor. A problem with this approach is that the product, such as a mattress, may not be readily accessible for proper consumer evaluation. Having products stick out into the aisles is also undesirable as that can impede consumer shopping and restocking activities. In this and other retail environments, there is a desire for improved retail display solutions such as for mattresses.

BRIEF SUMMARY OF THE INVENTION

A first aspect of the present invention is directed toward a movable mattress display that can be readily manipulated to move a mattress being displayed. A mattress display for displaying mattresses comprises a base frame comprising a pair of spaced apart and generally parallel angle bars in which the pair define an upwardly facing channel therebetween for supporting the mattress along a top side thereof. A plurality of wheels are mounted to the base frame such that a mattress display is mobile. Handle mounts are provided along a front one of the angle bars and a handle having a pair of vertically extending support elements and a horizontally extending gripping element is mounted to the handle mounts via the support elements.

Another aspect of the present invention is directed toward utilization of the handle to display signage and marketing information. According to this aspect, a mattress display for displaying a mattress comprises a base frame configured to hold the mattress and a plurality of wheels mounted to the base frame such that the mattress display is mobile. A handle is mounted to the base frame and extends vertically upward therefrom. A retail display sign is mounted to the handle and has marketing indicia thereon for conveying information to consumers and/or other persons.

Another aspect of the present invention is a method for displaying marketing information on signage such as signage for a mattress display. The method includes bending edge regions on both sides of sheet metal stock to create a sign body having a planar front and a pair of opposed bent mounting sides. Thereafter, the sign body is arranged in a fixture having slots that receive the bent mounting sides and has a planar support region for supporting the planar front of the sign body. This facilitates printing an image along the planar front of the sign body in which the image has marketing indicia thereon. The sign body can be painted such as via powder coating prior to the arrangement in the fixture and printing step.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 1:
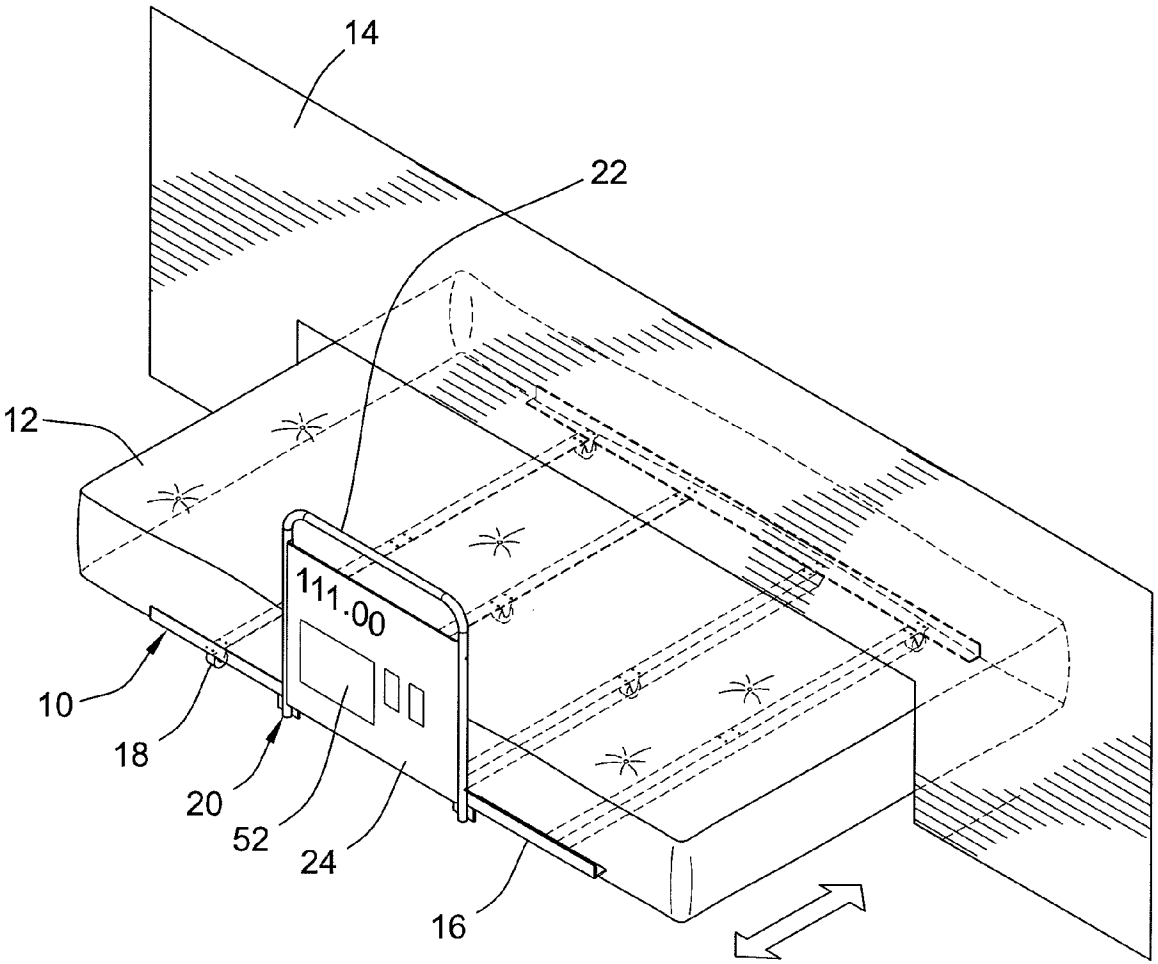
FIG. 1 is a perspective view of a mattress display in use with a mattress and a pallet rack, shown in partly schematic form, in accordance with an embodiment of the invention.
Figure 4:
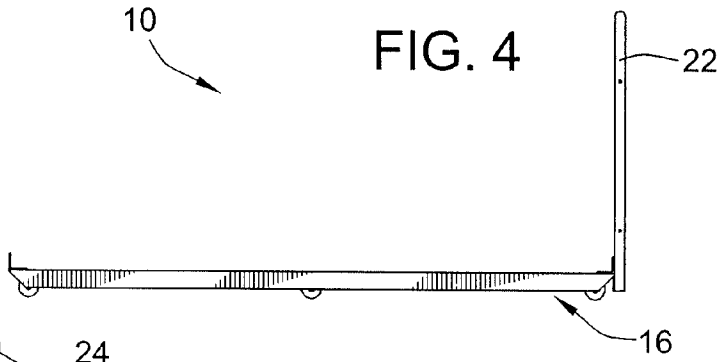
FIG. 4 is a side elevation view of the mattress display of FIG. 2.
Figure 3:
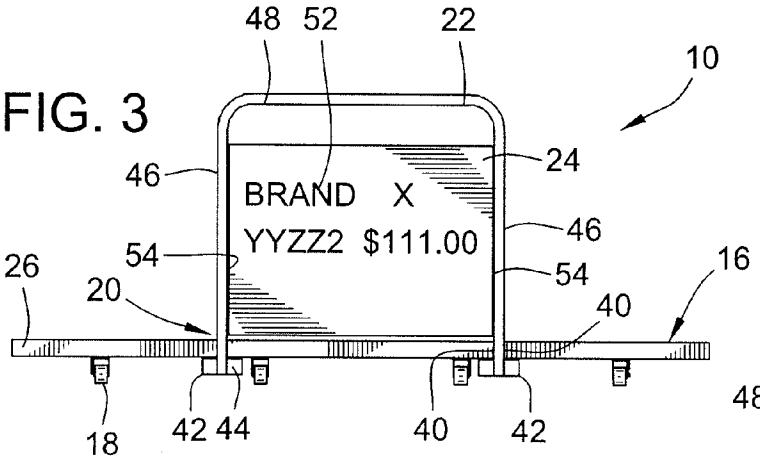
FIG. 3 is a frontal view of the mattress display of FIG. 2.
Figure 2:
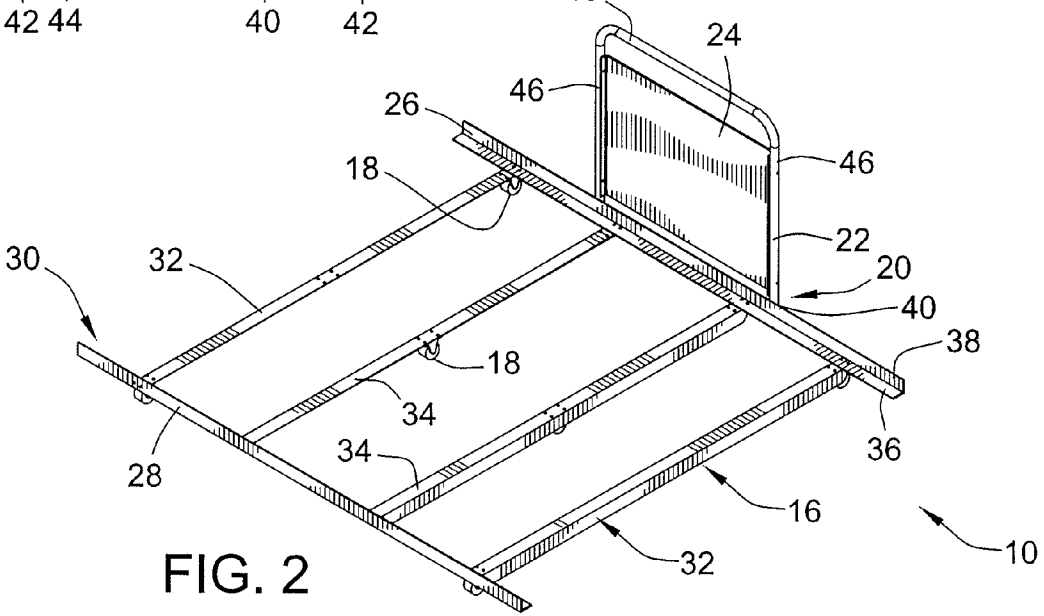
FIG. 2 is a isometric view of the mattress display shown in FIG. 1, but from a different angle and without the mattress or pallet rack illustrated.
Figure 5:
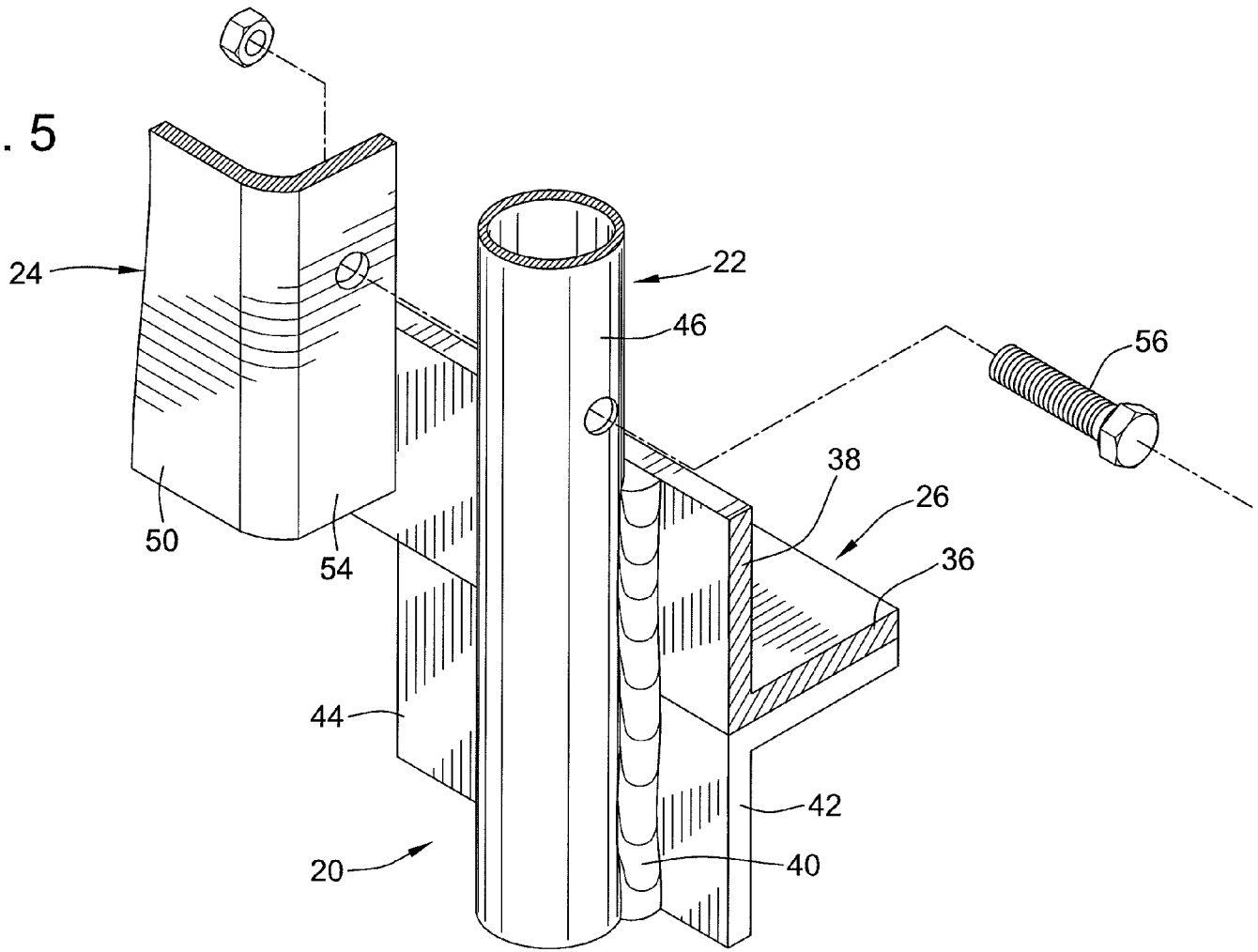
FIG. 5 is an enlarged partially exploded view of a portion of the mattress display at a handle mount region of the display.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Turning to the figures, an embodiment of the present invention has been illustrated as a mattress display 10 for displaying a mattress 12 and for providing marketing information pertaining to the mattress 12. While not limited thereto, this type of mattress display 10 can be particularly advantageous in warehouse stores where the display 10 can be tucked under pallet racks 14 and can be readily manipulated into and out from underneath the pallet racks 14. Specifically, consumers can wheel the mattress display 10 into an aisle of a store to facilitate examination and testing of the mattress if desired and can then tuck the mattress display 10 and the mattress 12 thereon back under the pallet racks 14 when finished. As such, the mattress display 10 is mobile to facilitate ready manipulation.

The mattress display generally includes various regions or portions to include a base frame 16, a plurality of wheels such as caster type wheels 18, handle mount regions 20 along the front of the base frame 16, a vertically extending handle 22 and a retail display sign 24. In the following paragraphs, preferred components and functions will be described for each of these different portions/regions.

The base frame 16 generally provides the structure which is configured to support and hold the mattress 12. The base frame 16 may comprise a plurality of angle bars to include a pair of spaced apart and generally parallel front and rear angle bars 26, 28 at the front and back ends of the mattress display, respectively. These angle bars generally define a support channel 30 therebetween for receiving and supporting the mattress 12. A plurality of lateral angle bars are also provided to include outer angle bars 32 and inner angle bars 34. These lateral angle bars 32, 34 extend laterally between the front and rear angle bars 26, 28 with the ends secured and more specifically fastened thereto to provide the structure of the base frame 16. As shown, each angle bar can include the horizontally extending flange 36 and a unitary vertically extending flange 38. In the case of the front and rear angle bars 26, 28 the vertically extending flange can be projecting upwardly, while in the case of the lateral angled bars, 32, 34, the vertically extending flange can be extending downwardly so as to provide a generally flat surface upon which the mattress can rest.

Along the front of the base frame 16 is provided the handle mount region 20 which includes a securing mechanism such as welds 40 for securement to the handle 22 and may also include a reinforcing structure to facilitate better load transfer between the base frame and the handle. For example, at least one reinforcing bar is mounted to an underside of the front angle bar 26, which may include a continuous or two separate angle bar segments arranged in horizontally spaced relation. These angle bar segments 42 are welded or otherwise secured together (e.g. fasteners) with the respective vertically extending flanges lying in the same plane to provide an extended front welding face 44 to which the handle 22 can be securably mounted such as by welding, fastening and/or the like.

The handle 22 includes a pair of vertically extending support elements 46 that are connected by a horizontally extending gripping element 48. Preferably, these elements 46, 48 can all be integrally and unitarily formed such as by hollow steel tubing that has two bent corners to differentiate the vertically extending support element 46 and a horizontally extending gripping element 48. The vertically extending support elements 46 have bottom ends that are mounted securely to the handle mount regions 20 provided along the front face of the base frame 16. Specifically, the bottom ends of the vertically extending support elements 46 can be welded via the welds 40 to provide for rigid attachment therebetween. The horizontally extending gripping element 48 is elevated above the ground between about two and four feet such that the handle rises to an elevation where it may be easily manipulated manually by a consumer. As shown, the horizontally extending gripping element 48 is separated from the top of the retail display sign that is carried by the handle 22 by a gap therebetween to allow sufficient room for one's hands to facilitate gripping and manipulation.

The retail display sign 24 is mounted to the handle 22 such as by fasteners. To provide for the retail display sign 24, preferably sheet metal stock is used which can have a planar front 50 with marketing indicia 52 thereon, and a pair of bent mounting sides 54 that extend rearwardly from the planar front 50. As shown, the retail display sign 24 can be mounted inside the boundary of the handle 22. Specifically, the mounting sides 54 can be fastened with fasteners 56 to the vertical extending support elements 46 of the handle 22 in spaced relation to the horizontally extending gripping region 48. Typical marketing indicia 52 may include such things as the brand name and model type, bar codes, and/or other information pertaining to the softness, firmness of the mattress, materials used in the mattress, and/or other information pertaining to the mattress to be displayed thereon.

Yet another feature is the provisions for multiple wheels that can be used to installed for easier mantipulation of the mattress display 10. Specifically, toward the end of the outer angle bars 32 (e.g. approximate the respective four corners of the base frame 16) are provided a total of four wheels 18 for support and mobility. To increase maneuverability and support, inner wheels 18 contained in an intermediate region between these outer wheels can be provided such as being mounted near the center of the two inner angled bars 34. For example, in this embodiment a total of six wheels 18 are shown illustrated but other embodiments may include more or less.

Figure 6:
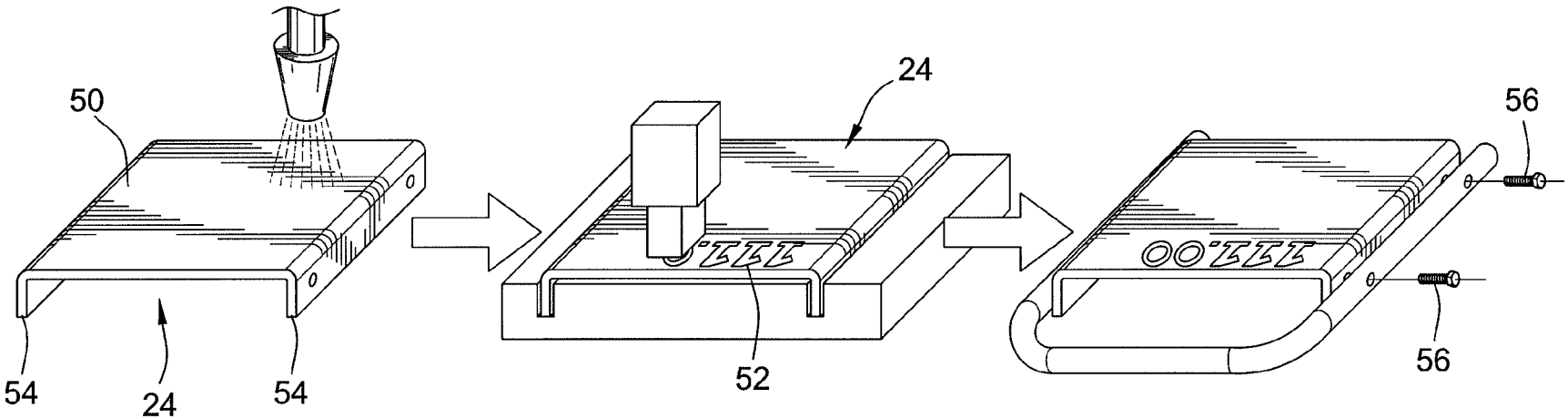
FIG. 6 is a schematic process diagram to show how the sign for the display can be made.

Yet a further feature as illustrated in FIG. 6 pertains to a method of displaying marketing information on the signage employed in the mattress display. Specifically, while using sheet metal is advantageous, it needs to be configured into the desired configuration for use in the assembly as well as facilitating graphics at the same time. In accordance therewith, to form the retail display sign 24 preferably that the following methodology can be employed. First, the edge regions are bent on opposed sides of flat sheet metal stock to create a sign body having a planar front and a pair of opposing bent mounting sides. Thereafter, at least a portion of the sign body and preferably the entire sign body is painted such as by powder coating. At this point, the sign body is arranged in a fixture which may, for purposes of simplicity, be a ply board sheet having slots therein for receiving the bent mounting sides and having a planar support region supporting the relatively thin planar front of the sign body. Thereafter, an image can be printed along the planar front to provide for marketing indicia thereon. For example, a flat bed printer such as a solvent ink jet printer can be used to impart a digital image across the planar front of the sign.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A mattress display for displaying a mattress, comprising:

a base frame comprising a pair of spaced apart and generally parallel angle bars, the pair together defining an upwardly facing channel therebetween for supporting the mattress along a top side thereof;

a plurality of wheels mounted to the base frame;

handle mounts along a front one of the angle bars; and a handle having a pair of vertically extending support elements and a horizontally extending gripping element, the support elements being mounted to the handle mounts;

wherein the handle mounts are provided by at least one reinforcing bar mounted to an underside of the front one of the angle bars;

wherein the at least one reinforcing bar includes a pair of angle bar segments welded to the underside of the base frame in spaced apart relation; and wherein each angle bar and each angle bar segment includes a vertically extending flange and a horizontally extending flange, the horizontal flanges of the front one of the angle bars and the angle bar segments abutting in surface to surface relation wherein the vertical flanges of the front one of the angle bars and the angle bar segments together define a generally planar vertically extending front welding face, each support element being welded along the front welding face to both of the front one of the angle bars and one of the angle bar segments.

2. The mattress display of claim 1, further comprising a plurality of lateral support angle bars extending laterally between the pair of generally parallel angle bars, ends of the lateral support angle bars being secured to the generally parallel angle bars, respectively.

3. The mattress display of claim 2, further including outer lateral support angle bars and inner lateral support angle bars disposed between the outer lateral support angle bars, further comprising four wheels mounted proximate ends of the outer lateral support bars and inner wheels mounted in an intermediate region of the inner support angle bars.

4. The mattress display of claim 1, wherein the handle comprises a unitary metal tube having a pair of corners joining the horizontally extending gripping element with the pair of vertically extending support elements, respectively.

5. The mattress display of claim 4, further comprising a retail display sign mounted to the handle, the retail display sign formed from sheet metal having a planar front with marketing indicia thereon and a pair of opposed bent mounting sides extending rearwardly from the planar front, the mounting sides being mounted to the vertical support elements.

6. The mattress display of claim 5, wherein the retail display sign is mounted inside of the handle between the vertically extending elements.

7. The mattress display of claim 1, further comprising a retail display sign mounted to the handle, the retail display sign having marketing indicia thereon.

8. A mattress display for displaying a mattress, comprising:

a base frame comprising a pair of spaced apart and generally parallel angle bars, the pair together defining an upwardly facing channel therebetween for supporting the mattress along a top side thereof;

a plurality of wheels mounted to the base frame;

handle mounts along a front one of the angle bars; and a handle having a pair of vertically extending support elements and a horizontally extending gripping element, the support elements being mounted to the handle mounts;

wherein the handle mounts are provided by at least one underside angle bar mounted to an underside of the front one of the angle bars;

wherein each angle bar and each at least one underside angle bar includes a vertically extending flange and a horizontally extending flange, the horizontal flanges of the front one of the angle bars and the at least one underside angle bar abutting in surface to surface relation wherein the vertical flanges of the front one of the angle bars and the at least one underside angle bar together define a generally planar vertically extending front welding face, each support element being welded along the front welding face to both of the front one of the angle bars and the at least one underside angle bar.

9. The mattress display of claim 8, further comprising a plurality of lateral support angle bars extending laterally between the pair of generally parallel angle bars, ends of the lateral support angle bars being secured to the generally parallel angle bars, respectively.

10. The mattress display of claim 9, further including outer lateral support angle bars and inner lateral support angle bars disposed between the outer lateral support angle bars, further comprising four wheels mounted proximate ends of the outer lateral support bars and inner wheels mounted in an intermediate region of the inner support angle bars.

11. The mattress display of claim 8, wherein the handle comprises a unitary metal tube having a pair of corners joining the horizontally extending gripping element with the pair of vertically extending support elements, respectively.

12. The mattress display of claim 11, further comprising a retail display sign mounted to the handle, the retail display sign formed from sheet metal having a planar front with marketing indicia thereon and a pair of opposed bent mounting sides extending rearwardly from the planar front, the mounting sides being mounted to the vertical support elements.

13. The mattress display of claim 12, wherein the retail display sign is mounted inside of the handle between the vertically extending elements.

14. The mattress display of claim 8, further comprising a retail display sign mounted to the handle, the retail display sign having marketing indicia thereon.

* * * * *